US009741282B2

(12) United States Patent
Giannikouris et al.

(10) Patent No.: US 9,741,282 B2
(45) Date of Patent: Aug. 22, 2017

(54) OLED DISPLAY SYSTEM AND METHOD

(71) Applicant: Ignis Innovation Inc., Waterloo (CA)

(72) Inventors: Allyson Giannikouris, Kitchener (CA); Jaimal Soni, Waterloo (CA); Nino Zahirovic, Waterloo (CA); Ricky Yik Hei Ngan, Richmond Hills (CA); Gholamreza' Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 135 days.

(21) Appl. No.: 14/561,404

(22) Filed: Dec. 5, 2014

(65) Prior Publication Data

US 2015/0161935 A1 Jun. 11, 2015

Related U.S. Application Data

(60) Provisional application No. 61/976,909, filed on Apr. 8, 2014, provisional application No. 61/912,786, filed on Dec. 6, 2013.

(51) Int. Cl.

| | |
|---|---|
| ***G09G 3/20*** | (2006.01) |
| ***G09G 3/3208*** | (2016.01) |
| ***G09G 3/3233*** | (2016.01) |

(52) U.S. Cl.

CPC ..... *G09G 3/2074* (2013.01); *G09G 3/2003* (2013.01); *G09G 3/3208* (2013.01); *G09G 3/3233* (2013.01); *G09G 2300/0452* (2013.01); *G09G 2300/0852* (2013.01); *G09G 2320/0238* (2013.01); *G09G 2320/0276* (2013.01);

(Continued)

(58) Field of Classification Search

None

See application file for complete search history.

(56) References Cited

U.S. PATENT DOCUMENTS

| | | | |
|---|---|---|---|
| 3,506,851 | A | 4/1970 | Polkinghorn |
| 3,774,055 | A | 11/1973 | Bapat |

(Continued)

FOREIGN PATENT DOCUMENTS

| | | |
|---|---|---|
| CA | 1 294 034 | 1/1992 |
| CA | 2 109 951 | 11/1992 |

(Continued)

OTHER PUBLICATIONS

Ahnood : "Effect of threshold voltage instability on field effect mobility in thin film transistors deduced from constant current measurements"; dated Aug. 2009.

(Continued)

*Primary Examiner* — Shaheda Abdin

(74) *Attorney, Agent, or Firm* — Nixon Peabody LLP

(57) ABSTRACT

A method and system control an OLED display to achieve desired color points and brightness levels in an array of pixels in which each pixel includes at least three sub-pixels having different colors and at least one white sub-pixel. The method and system select a plurality of reference points in the pixel content domain with known color points and brightness levels. For each set of three sub-pixels of different colors, the method and system determine the share of each sub-pixel to produce the color point and brightness level of each selected reference point, and select the maximum share determined for each sub-pixel as peak brightness needed from that sub-pixel.

14 Claims, 7 Drawing Sheets

(52) U.S. Cl.
CPC ..... *G09G 2320/0673* (2013.01); *G09G 2330/021* (2013.01); *G09G 2340/06* (2013.01)

(56) References Cited

U.S. PATENT DOCUMENTS

| | | | |
|---|---|---|---|
| 4,090,096 | A | 5/1978 | Nagami |
| 4,160,934 | A | 7/1979 | Kirsch |
| 4,354,162 | A | 10/1982 | Wright |
| 4,943,956 | A | 7/1990 | Noro |
| 4,996,523 | A | 2/1991 | Bell |
| 5,153,420 | A | 10/1992 | Hack |
| 5,198,803 | A | 3/1993 | Shie |
| 5,204,661 | A | 4/1993 | Hack |
| 5,266,515 | A | 11/1993 | Robb |
| 5,489,918 | A | 2/1996 | Mosier |
| 5,498,880 | A | 3/1996 | Lee |
| 5,557,342 | A | 9/1996 | Eto |
| 5,572,444 | A | 11/1996 | Lentz |
| 5,589,847 | A | 12/1996 | Lewis |
| 5,619,033 | A | 4/1997 | Weisfield |
| 5,648,276 | A | 7/1997 | Hara |
| 5,670,973 | A | 9/1997 | Bassetti |
| 5,684,365 | A | 11/1997 | Tang |
| 5,691,783 | A | 11/1997 | Numao |
| 5,714,968 | A | 2/1998 | Ikeda |
| 5,723,950 | A | 3/1998 | Wei |
| 5,744,824 | A | 4/1998 | Kousai |
| 5,745,660 | A | 4/1998 | Kolpatzik |
| 5,748,160 | A | 5/1998 | Shieh |
| 5,815,303 | A | 9/1998 | Berlin |
| 5,870,071 | A | 2/1999 | Kawahata |
| 5,874,803 | A | 2/1999 | Garbuzov |
| 5,880,582 | A | 3/1999 | Sawada |
| 5,903,248 | A | 5/1999 | Irwin |
| 5,917,280 | A | 6/1999 | Burrows |
| 5,923,794 | A | 7/1999 | McGrath |
| 5,945,972 | A | 8/1999 | Okumura |
| 5,949,398 | A | 9/1999 | Kim |
| 5,952,789 | A | 9/1999 | Stewart |
| 5,952,991 | A | 9/1999 | Akiyama |
| 5,982,104 | A | 11/1999 | Sasaki |
| 5,990,629 | A | 11/1999 | Yamada |
| 6,023,259 | A | 2/2000 | Howard |
| 6,069,365 | A | 5/2000 | Chow |
| 6,091,203 | A | 7/2000 | Kawashima |
| 6,097,360 | A | 8/2000 | Holloman |
| 6,144,222 | A | 11/2000 | Ho |
| 6,177,915 | B1 | 1/2001 | Beeteson |
| 6,229,506 | B1 | 5/2001 | Dawson |
| 6,229,508 | B1 | 5/2001 | Kane |
| 6,246,180 | B1 | 6/2001 | Nishigaki |
| 6,252,248 | B1 | 6/2001 | Sano |
| 6,259,424 | B1 | 7/2001 | Kurogane |
| 6,262,589 | B1 | 7/2001 | Tamukai |
| 6,271,825 | B1 | 8/2001 | Greene |
| 6,288,696 | B1 | 9/2001 | Holloman |
| 6,304,039 | B1 | 10/2001 | Appelberg |
| 6,307,322 | B1 | 10/2001 | Dawson |
| 6,310,962 | B1 | 10/2001 | Chung |
| 6,320,325 | B1 | 11/2001 | Cok |
| 6,323,631 | B1 | 11/2001 | Juang |
| 6,356,029 | B1 | 3/2002 | Hunter |
| 6,373,454 | B1 | 4/2002 | Knapp |
| 6,392,617 | B1 | 5/2002 | Gleason |
| 6,414,661 | B1 | 7/2002 | Shen |
| 6,417,825 | B1 | 7/2002 | Stewart |
| 6,433,488 | B1 | 8/2002 | Bu |
| 6,437,106 | B1 | 8/2002 | Stoner |
| 6,445,369 | B1 | 9/2002 | Yang |
| 6,475,845 | B2 | 11/2002 | Kimura |
| 6,501,098 | B2 | 12/2002 | Yamazaki |
| 6,501,466 | B1 | 12/2002 | Yamagishi |
| 6,518,962 | B2 | 2/2003 | Kimura |
| 6,522,315 | B2 | 2/2003 | Ozawa |
| 6,525,683 | B1 | 2/2003 | Gu |
| 6,531,827 | B2 | 3/2003 | Kawashima |
| 6,542,138 | B1 | 4/2003 | Shannon |
| 6,555,420 | B1 | 4/2003 | Yamazaki |
| 6,580,408 | B1 | 6/2003 | Bae |
| 6,580,657 | B2 | 6/2003 | Sanford |
| 6,583,398 | B2 | 6/2003 | Harkin |
| 6,583,775 | B1 | 6/2003 | Sekiya |
| 6,594,606 | B2 | 7/2003 | Everitt |
| 6,618,030 | B2 | 9/2003 | Kane |
| 6,639,244 | B1 | 10/2003 | Yamazaki |
| 6,668,645 | B1 | 12/2003 | Gilmour |
| 6,677,713 | B1 | 1/2004 | Sung |
| 6,680,580 | B1 | 1/2004 | Sung |
| 6,687,266 | B1 | 2/2004 | Ma |
| 6,690,000 | B1 | 2/2004 | Muramatsu |
| 6,690,344 | B1 | 2/2004 | Takeuchi |
| 6,693,388 | B2 | 2/2004 | Oomura |
| 6,693,610 | B2 | 2/2004 | Shannon |
| 6,697,057 | B2 | 2/2004 | Koyama |
| 6,720,942 | B2 | 4/2004 | Lee |
| 6,724,151 | B2 | 4/2004 | Yoo |
| 6,734,636 | B2 | 5/2004 | Sanford |
| 6,738,034 | B2 | 5/2004 | Kaneko |
| 6,738,035 | B1 | 5/2004 | Fan |
| 6,753,655 | B2 | 6/2004 | Shih |
| 6,753,834 | B2 | 6/2004 | Mikami |
| 6,756,741 | B2 | 6/2004 | Li |
| 6,756,952 | B1 | 6/2004 | Decaux |
| 6,756,958 | B2 | 6/2004 | Furuhashi |
| 6,771,028 | B1 | 8/2004 | Winters |
| 6,777,712 | B2 | 8/2004 | Sanford |
| 6,777,888 | B2 | 8/2004 | Kondo |
| 6,781,567 | B2 | 8/2004 | Kimura |
| 6,806,497 | B2 | 10/2004 | Jo |
| 6,806,638 | B2 | 10/2004 | Lin |
| 6,806,857 | B2 | 10/2004 | Sempel |
| 6,809,706 | B2 | 10/2004 | Shimoda |
| 6,815,975 | B2 | 11/2004 | Nara |
| 6,828,950 | B2 | 12/2004 | Koyama |
| 6,853,371 | B2 | 2/2005 | Miyajima |
| 6,859,193 | B1 | 2/2005 | Yumoto |
| 6,873,117 | B2 | 3/2005 | Ishizuka |
| 6,876,346 | B2 | 4/2005 | Anzai |
| 6,885,356 | B2 | 4/2005 | Hashimoto |
| 6,900,485 | B2 | 5/2005 | Lee |
| 6,903,734 | B2 | 6/2005 | Eu |
| 6,909,243 | B2 | 6/2005 | Inukai |
| 6,909,419 | B2 | 6/2005 | Zavracky |
| 6,911,960 | B1 | 6/2005 | Yokoyama |
| 6,911,964 | B2 | 6/2005 | Lee |
| 6,914,448 | B2 | 7/2005 | Jinno |
| 6,919,871 | B2 | 7/2005 | Kwon |
| 6,924,602 | B2 | 8/2005 | Komiya |
| 6,937,215 | B2 | 8/2005 | Lo |
| 6,937,220 | B2 | 8/2005 | Kitaura |
| 6,940,214 | B1 | 9/2005 | Komiya |
| 6,943,500 | B2 | 9/2005 | LeChevalier |
| 6,947,022 | B2 | 9/2005 | McCartney |
| 6,954,194 | B2 | 10/2005 | Matsumoto |
| 6,956,547 | B2 | 10/2005 | Bae |
| 6,975,142 | B2 | 12/2005 | Azami |
| 6,975,332 | B2 | 12/2005 | Arnold |
| 6,995,510 | B2 | 2/2006 | Murakami |
| 6,995,519 | B2 | 2/2006 | Arnold |
| 7,023,408 | B2 | 4/2006 | Chen |
| 7,027,015 | B2 | 4/2006 | Booth, Jr. |
| 7,027,078 | B2 | 4/2006 | Reihl |
| 7,034,793 | B2 | 4/2006 | Sekiya |
| 7,038,392 | B2 | 5/2006 | Libsch |
| 7,057,359 | B2 | 6/2006 | Hung |
| 7,061,451 | B2 | 6/2006 | Kimura |
| 7,064,733 | B2 | 6/2006 | Cok |
| 7,071,932 | B2 | 7/2006 | Libsch |
| 7,088,051 | B1 | 8/2006 | Cok |
| 7,088,052 | B2 | 8/2006 | Kimura |
| 7,102,378 | B2 | 9/2006 | Kuo |
| 7,106,285 | B2 | 9/2006 | Naugler |
| 7,112,820 | B2 | 9/2006 | Chang |
| 7,116,058 | B2 | 10/2006 | Lo |

(56) References Cited

U.S. PATENT DOCUMENTS

| | | | |
|---|---|---|---|
| 7,119,493 | B2 | 10/2006 | Fryer |
| 7,122,835 | B1 | 10/2006 | Ikeda |
| 7,127,380 | B1 | 10/2006 | Iverson |
| 7,129,914 | B2 | 10/2006 | Knapp |
| 7,161,566 | B2 | 1/2007 | Cok |
| 7,164,417 | B2 | 1/2007 | Cok |
| 7,193,589 | B2 | 3/2007 | Yoshida |
| 7,224,332 | B2 | 5/2007 | Cok |
| 7,227,519 | B1 | 6/2007 | Kawase |
| 7,245,277 | B2 | 7/2007 | Ishizuka |
| 7,248,236 | B2 | 7/2007 | Nathan |
| 7,262,753 | B2 | 8/2007 | Tanghe |
| 7,274,363 | B2 | 9/2007 | Ishizuka |
| 7,310,092 | B2 | 12/2007 | Imamura |
| 7,315,295 | B2 | 1/2008 | Kimura |
| 7,321,348 | B2 | 1/2008 | Cok |
| 7,339,560 | B2 | 3/2008 | Sun |
| 7,355,574 | B1 | 4/2008 | Leon |
| 7,358,941 | B2 | 4/2008 | Ono |
| 7,368,868 | B2 | 5/2008 | Sakamoto |
| 7,397,485 | B2 | 7/2008 | Miller |
| 7,411,571 | B2 | 8/2008 | Huh |
| 7,414,600 | B2 | 8/2008 | Nathan |
| 7,423,617 | B2 | 9/2008 | Giraldo |
| 7,453,054 | B2 | 11/2008 | Lee |
| 7,474,285 | B2 | 1/2009 | Kimura |
| 7,502,000 | B2 | 3/2009 | Yuki |
| 7,528,812 | B2 | 5/2009 | Tsuge |
| 7,535,449 | B2 | 5/2009 | Miyazawa |
| 7,554,512 | B2 | 6/2009 | Steer |
| 7,569,849 | B2 | 8/2009 | Nathan |
| 7,576,718 | B2 | 8/2009 | Miyazawa |
| 7,580,012 | B2 | 8/2009 | Kim |
| 7,589,707 | B2 | 9/2009 | Chou |
| 7,609,239 | B2 | 10/2009 | Chang |
| 7,619,594 | B2 | 11/2009 | Hu |
| 7,619,597 | B2 | 11/2009 | Nathan |
| 7,633,470 | B2 | 12/2009 | Kane |
| 7,656,370 | B2 | 2/2010 | Schneider |
| 7,800,558 | B2 | 9/2010 | Routley |
| 7,847,764 | B2 | 12/2010 | Cok |
| 7,859,492 | B2 | 12/2010 | Kohno |
| 7,868,859 | B2 | 1/2011 | Tomida |
| 7,876,294 | B2 | 1/2011 | Sasaki |
| 7,924,249 | B2 | 4/2011 | Nathan |
| 7,932,883 | B2 | 4/2011 | Klompenhouwer |
| 7,969,390 | B2 | 6/2011 | Yoshida |
| 7,978,187 | B2 | 7/2011 | Nathan |
| 7,994,712 | B2 | 8/2011 | Sung |
| 8,026,876 | B2 | 9/2011 | Nathan |
| 8,049,420 | B2 | 11/2011 | Tamura |
| 8,077,123 | B2 | 12/2011 | Naugler, Jr. |
| 8,115,707 | B2 | 2/2012 | Nathan |
| 8,208,084 | B2 | 6/2012 | Lin |
| 8,223,177 | B2 | 7/2012 | Nathan |
| 8,232,939 | B2 | 7/2012 | Nathan |
| 8,259,044 | B2 | 9/2012 | Nathan |
| 8,264,431 | B2 | 9/2012 | Bulovic |
| 8,279,143 | B2 | 10/2012 | Nathan |
| 8,339,386 | B2 | 12/2012 | Leon |
| 8,441,206 | B2 | 5/2013 | Myers |
| 8,493,296 | B2 | 7/2013 | Ogawa |
| 2001/0002703 | A1 | 6/2001 | Koyama |
| 2001/0009283 | A1 | 7/2001 | Arao |
| 2001/0024181 | A1 | 9/2001 | Kubota |
| 2001/0024186 | A1 | 9/2001 | Kane |
| 2001/0026257 | A1 | 10/2001 | Kimura |
| 2001/0030323 | A1 | 10/2001 | Ikeda |
| 2001/0035863 | A1 | 11/2001 | Kimura |
| 2001/0040541 | A1 | 11/2001 | Yoneda |
| 2001/0043173 | A1 | 11/2001 | Troutman |
| 2001/0045929 | A1 | 11/2001 | Prache |
| 2001/0052606 | A1 | 12/2001 | Sempel |
| 2001/0052940 | A1 | 12/2001 | Hagihara |
| 2002/0000576 | A1 | 1/2002 | Inukai |
| 2002/0011796 | A1 | 1/2002 | Koyama |
| 2002/0011799 | A1 | 1/2002 | Kimura |
| 2002/0012057 | A1 | 1/2002 | Kimura |
| 2002/0014851 | A1 | 2/2002 | Tai |
| 2002/0018034 | A1 | 2/2002 | Ohki |
| 2002/0030190 | A1 | 3/2002 | Ohtani |
| 2002/0047565 | A1 | 4/2002 | Nara |
| 2002/0052086 | A1 | 5/2002 | Maeda |
| 2002/0067134 | A1 | 6/2002 | Kawashima |
| 2002/0084463 | A1 | 7/2002 | Sanford |
| 2002/0101172 | A1 | 8/2002 | Bu |
| 2002/0105279 | A1 | 8/2002 | Kimura |
| 2002/0117722 | A1 | 8/2002 | Osada |
| 2002/0122308 | A1 | 9/2002 | Ikeda |
| 2002/0158587 | A1 | 10/2002 | Komiya |
| 2002/0158666 | A1 | 10/2002 | Azami |
| 2002/0158823 | A1 | 10/2002 | Zavracky |
| 2002/0167471 | A1 | 11/2002 | Everitt |
| 2002/0167474 | A1 | 11/2002 | Everitt |
| 2002/0180369 | A1 | 12/2002 | Koyama |
| 2002/0180721 | A1 | 12/2002 | Kimura |
| 2002/0181276 | A1 | 12/2002 | Yamazaki |
| 2002/0186214 | A1 | 12/2002 | Siwinski |
| 2002/0190924 | A1 | 12/2002 | Asano |
| 2002/0190971 | A1 | 12/2002 | Nakamura |
| 2002/0195967 | A1 | 12/2002 | Kim |
| 2002/0195968 | A1 | 12/2002 | Sanford |
| 2003/0020413 | A1 | 1/2003 | Oomura |
| 2003/0030603 | A1 | 2/2003 | Shimoda |
| 2003/0043088 | A1 | 3/2003 | Booth |
| 2003/0057895 | A1 | 3/2003 | Kimura |
| 2003/0058226 | A1 | 3/2003 | Bertram |
| 2003/0062524 | A1 | 4/2003 | Kimura |
| 2003/0063081 | A1 | 4/2003 | Kimura |
| 2003/0071821 | A1 | 4/2003 | Sundahl |
| 2003/0076048 | A1 | 4/2003 | Rutherford |
| 2003/0090447 | A1 | 5/2003 | Kimura |
| 2003/0090481 | A1 | 5/2003 | Kimura |
| 2003/0107560 | A1 | 6/2003 | Yumoto |
| 2003/0111966 | A1 | 6/2003 | Mikami |
| 2003/0122745 | A1 | 7/2003 | Miyazawa |
| 2003/0122813 | A1 | 7/2003 | Ishizuki |
| 2003/0142088 | A1 | 7/2003 | LeChevalier |
| 2003/0151569 | A1 | 8/2003 | Lee |
| 2003/0156101 | A1 | 8/2003 | Le Chevalier |
| 2003/0174152 | A1 | 9/2003 | Noguchi |
| 2003/0179626 | A1 | 9/2003 | Sanford |
| 2003/0185438 | A1 | 10/2003 | Osawa |
| 2003/0197663 | A1 | 10/2003 | Lee |
| 2003/0210256 | A1 | 11/2003 | Mori |
| 2003/0230141 | A1 | 12/2003 | Gilmour |
| 2003/0230980 | A1 | 12/2003 | Forrest |
| 2003/0231148 | A1 | 12/2003 | Lin |
| 2004/0032382 | A1 | 2/2004 | Cok |
| 2004/0041750 | A1 | 3/2004 | Abe |
| 2004/0066357 | A1 | 4/2004 | Kawasaki |
| 2004/0070557 | A1 | 4/2004 | Asano |
| 2004/0070565 | A1 | 4/2004 | Nayar |
| 2004/0090186 | A1 | 5/2004 | Kanauchi |
| 2004/0090400 | A1 | 5/2004 | Yoo |
| 2004/0095297 | A1 | 5/2004 | Libsch |
| 2004/0100427 | A1 | 5/2004 | Miyazawa |
| 2004/0108518 | A1 | 6/2004 | Jo |
| 2004/0135749 | A1 | 7/2004 | Kondakov |
| 2004/0140982 | A1 | 7/2004 | Pate |
| 2004/0145547 | A1 | 7/2004 | Oh |
| 2004/0150592 | A1 | 8/2004 | Mizukoshi |
| 2004/0150594 | A1 | 8/2004 | Koyama |
| 2004/0150595 | A1 | 8/2004 | Kasai |
| 2004/0155841 | A1 | 8/2004 | Kasai |
| 2004/0174347 | A1 | 9/2004 | Sun |
| 2004/0174349 | A1 | 9/2004 | Libsch |
| 2004/0174354 | A1 | 9/2004 | Ono |
| 2004/0178743 | A1 | 9/2004 | Miller |
| 2004/0183759 | A1 | 9/2004 | Stevenson |
| 2004/0196275 | A1 | 10/2004 | Hattori |
| 2004/0207615 | A1 | 10/2004 | Yumoto |
| 2004/0227697 | A1 | 11/2004 | Mori |
| 2004/0233125 | A1 | 11/2004 | Tanghe |

(56) References Cited

U.S. PATENT DOCUMENTS

2004/0239596 A1 12/2004 Ono
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007249 A1 1/2006 Reddy
2006/0012310 A1 1/2006 Chen
2006/0012311 A1 1/2006 Ogawa
2006/0022305 A1 2/2006 Yamashita
2006/0027807 A1 2/2006 Nathan
2006/0030084 A1 2/2006 Young
2006/0038758 A1 2/2006 Routley
2006/0038762 A1 2/2006 Chou
2006/0044227 A1 3/2006 Hadcock
2006/0066533 A1 3/2006 Sato
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103611 A1 5/2006 Choi
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0232522 A1 10/2006 Roy
2006/0244697 A1 11/2006 Lee
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok et al.
2007/0103419 A1 5/2007 Uchino
2007/0115221 A1 5/2007 Buchhauser
2007/0126672 A1 6/2007 Tada et al.
2007/0164664 A1 7/2007 Ludwicki
2007/0182671 A1 8/2007 Nathan
2007/0236134 A1 10/2007 Ho
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1 2/2008 Kitazawa
2008/0036708 A1 2/2008 Shirasaki
2008/0042942 A1 2/2008 Takahashi
2008/0042948 A1 2/2008 Yamashita
2008/0048951 A1 2/2008 Naugler, Jr.
2008/0055209 A1 3/2008 Cok
2008/0055211 A1 3/2008 Ogawa
2008/0074413 A1 3/2008 Ogura
2008/0088549 A1 4/2008 Nathan
2008/0088648 A1 4/2008 Nathan
2008/0111766 A1 5/2008 Uchino
2008/0116787 A1 5/2008 Hsu
2008/0117144 A1 5/2008 Nakano et al.
2008/0136770 A1 6/2008 Peker
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0231558 A1 9/2008 Naugler
2008/0231562 A1 9/2008 Kwon
2008/0231625 A1 9/2008 Minami
2008/0252223 A1 10/2008 Toyoda
2008/0252571 A1 10/2008 Hente
2008/0259020 A1 10/2008 Fisekovic
2008/0290805 A1 11/2008 Yamada
2008/0297055 A1 12/2008 Miyake
2009/0058772 A1 3/2009 Lee
2009/0109142 A1 4/2009 Takahara
2009/0121994 A1 5/2009 Miyata
2009/0146926 A1 6/2009 Sung
2009/0160743 A1 6/2009 Tomida
2009/0174628 A1 7/2009 Wang
2009/0184901 A1 7/2009 Kwon
2009/0195483 A1 8/2009 Naugler, Jr.
2009/0201281 A1 8/2009 Routley

(56) References Cited

U.S. PATENT DOCUMENTS

| | | | | |
|---|---|---|---|---|
| 2009/0206764 | A1 | 8/2009 | Schemmann | |
| 2009/0213046 | A1 | 8/2009 | Nam | |
| 2009/0244046 | A1 | 10/2009 | Seto | |
| 2009/0262047 | A1 | 10/2009 | Yamashita | |
| 2010/0004891 | A1 | 1/2010 | Ahlers | |
| 2010/0026725 | A1 | 2/2010 | Smith | |
| 2010/0039422 | A1 | 2/2010 | Seto | |
| 2010/0039458 | A1 | 2/2010 | Nathan | |
| 2010/0060911 | A1 | 3/2010 | Marcu | |
| 2010/0079419 | A1 | 4/2010 | Shibusawa | |
| 2010/0165002 | A1 | 7/2010 | Ahn | |
| 2010/0194670 | A1 | 8/2010 | Cok | |
| 2010/0207960 | A1 | 8/2010 | Kimpe | |
| 2010/0225630 | A1 | 9/2010 | Levey | |
| 2010/0251295 | A1 | 9/2010 | Amento | |
| 2010/0277400 | A1 | 11/2010 | Jeong | |
| 2010/0315319 | A1 | 12/2010 | Cok | |
| 2010/0315449 | A1* | 12/2010 | Chaji | G09G 3/3208 345/690 |
| 2011/0063197 | A1 | 3/2011 | Chung | |
| 2011/0069051 | A1 | 3/2011 | Nakamura | |
| 2011/0069089 | A1 | 3/2011 | Kopf | |
| 2011/0069094 | A1* | 3/2011 | Knapp | G09G 3/2003 345/690 |
| 2011/0074750 | A1 | 3/2011 | Leon | |
| 2011/0149166 | A1 | 6/2011 | Botzas | |
| 2011/0169798 | A1 | 7/2011 | Lee | |
| 2011/0181630 | A1 | 7/2011 | Smith | |
| 2011/0199395 | A1 | 8/2011 | Nathan | |
| 2011/0227964 | A1 | 9/2011 | Chaji | |
| 2011/0242074 | A1 | 10/2011 | Bert | |
| 2011/0273399 | A1 | 11/2011 | Lee | |
| 2011/0293480 | A1 | 12/2011 | Mueller | |
| 2012/0056558 | A1 | 3/2012 | Toshiya | |
| 2012/0062565 | A1 | 3/2012 | Fuchs | |
| 2012/0262184 | A1 | 10/2012 | Shen | |
| 2012/0299970 | A1 | 11/2012 | Bae | |
| 2012/0299978 | A1 | 11/2012 | Chaji | |
| 2013/0027381 | A1 | 1/2013 | Nathan | |
| 2013/0057595 | A1 | 3/2013 | Nathan | |
| 2013/0112960 | A1 | 5/2013 | Chaji | |
| 2013/0135272 | A1 | 5/2013 | Park | |
| 2013/0162617 | A1 | 6/2013 | Yoon | |
| 2013/0201223 | A1 | 8/2013 | Li et al. | |
| 2013/0309821 | A1 | 11/2013 | Yoo | |
| 2013/0321671 | A1 | 12/2013 | Cote | |
| 2014/0111567 | A1 | 4/2014 | Nathan et al. | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1682267 | A | 10/2005 |
| CN | 1760945 | | 4/2006 |
| CN | 1886774 | | 12/2006 |
| CN | 102656621 | | 9/2012 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2008-102335 | | 5/2008 |
| JP | 4-158570 | | 10/2008 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 98/48403 | | 10/1998 |
| WO | WO 99/48079 | | 9/1999 |
| WO | WO 01/06484 | | 1/2001 |
| WO | WO 01/27910 | A1 | 4/2001 |
| WO | WO 01/63587 | A2 | 8/2001 |
| WO | WO 02/067327 | A | 8/2002 |
| WO | WO 03/001496 | A1 | 1/2003 |
| WO | WO 03/034389 | A | 4/2003 |
| WO | WO 03/058594 | A1 | 7/2003 |
| WO | WO 03/063124 | | 7/2003 |
| WO | WO 03/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |

(56) References Cited

FOREIGN PATENT DOCUMENTS

| | | | |
|---|---|---|---|
| WO | WO 2005/029455 | | 3/2005 |
| WO | WO 2005/029456 | | 3/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).
Alexander : "Unique Electrical Measurement Technology for Compensation, Inspection, and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Current-Mode Comparator for Digital Calibration of Amorphous Silicon AMOLED Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A Novel Driving Scheme for High Resolution Large-area a-SI:H AMOLED displays"; dated Aug. 2005 (3 pages).
Chaji : "A Stable Voltage-Programmed Pixel Circuit for a-Si:H AMOLED Displays"; dated Dec. 2006 (12 pages).
Chaji : "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degradation"; dated Dec. 2007 (3 pages).
Chaji : "eUTDSP: a design study of a new VLIW-based DSP architecture"; dated My 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision, fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 01 11 22313 dated Sep. 14, 2005 (4 pages).
European Search Report for Application No. EP 04 78 6661 dated Mar. 9, 2009.
European Search Report for Application No. EP 05 75 9141 dated Oct. 30, 2009. (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Search Report for Application No. PCT/CA2006/000177 dated Jun. 2, 2006.
European Supplementary Search Report for Application No. EP 04 78 6662 dated Jan. 19, 2007 (2 pages).
Extended European Search Report for Application No. 11 73 9485.8 mailed Aug. 6, 2013(14 pages).
Extended European Search Report for Application No. EP 09 73 3076.5, mailed Apr. 27, (13 pages).
Extended European Search Report for Application No. EP 11 16 8677.0, mailed Nov. 29, 2012, (13 page).
Extended European Search Report for Application No. EP 11 19 1641.7 mailed Jul. 11, 2012 (14 pages).
Extended European Search Report for Application No. EP 10834297 mailed Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.

(56) References Cited

OTHER PUBLICATIONS

International Search Report for Application No. PCT/CA2005/001897, mailed Mar. 21, 2006 (2 pages).
International Search Report for Application No. PCT/CA2007/000652 dated Jul. 25, 2007.
International Search Report for Application No. PCT/CA2009/000501, mailed Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, Dated Apr. 19, 2011, 5 pages.
International Search Report for Application No. PCT/IB2014/060959, Dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, mailed Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, mailed Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, mailed Mar. 21, 2006 (4 pages).
International Written Opinion for Application No. PCT/CA2009/000501 mailed Jul. 30, 2009 (6 pages).
International Written Opinion for Application No. PCT/IB2010/055481, dated Apr. 7, 2011, 6 pages.
International Written Opinion for Application No. PCT/IB2010/055486, Dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, mailed Sep. 12, 2012 (6 pages).
International Written Opinion for Application No. PCT/IB2013/054251, Canadian Intellectual Property Office, dated Sep. 11, 2013; (5 pages).
International Written Opinion for Application No. PCT/IB2014/060879, Canadian Intellectual Property Office, dated Jul. 17, 2014; (4 pages).
Jafarabadiashtiani : "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).
Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2006-527247 dated Mar. 15, 2010. (8 pages).
Office Action in Japanese patent application no. JP2007-545796 dated Sep. 5, 2011. (8 pages).
Office Action in Japanese patent application No. JP2012-541612 dated Jul. 15, 2014. (3 pages).
Partial European Search Report for Application No. EP 11 168 677.0, mailed Sep. 22, 2011 (5 pages).
Partial European Search Report for Application No. EP 11 19 1641.7, mailed Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Search Report for Taiwan Invention Patent Application No. 093128894 dated May 1, 2012. (1 page).
Search Report for Taiwan Invention Patent Application No. 94144535 dated Nov. 1, 2012. (1 page).
Singh,, "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. , "polysilicon TFT technology for active matrix oled displays" IEEE transactions on electron devices, vol. 48, No. 5, dated May 2001 (7 pages).
Vygranenko : "Stability of indium-oxide thin-film transistors by reactive ion beam assisted deposition"; dated 2009.

(56) References Cited

OTHER PUBLICATIONS

Wang : "Indium oxides by reactive ion beam assisted evaporation: From material study to device application"; dated Mar. 2009 (6 pages).
Yi He , "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, mailed Jul. 29, 2014, (4 pages).
Office Action in Chinese Patent Invention No. 201180008188.9, dated Jun. 4, 2014 (17 pages).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, mailed Mar. 9, 2015, (9 pages).
Extended European Search Report for Application No. EP 14181848.4, mailed Mar. 5, 2015, (8 pages).

* cited by examiner

OLED DISPLAY SYSTEM AND METHOD

CROSS REFERENCE TO RELATED APPLICATION

This application claims the benefit of U.S. Provisional Patent Applications Nos. 61/976,909, filed Apr. 8, 2014, and 61/912,786, filed Dec. 6, 2013, each of which is hereby incorporated by reference in its entirety.

FIELD OF THE INVENTION

The present invention relates generally to OLED displays and, more particularly, to an OLED display system and method for improving color accuracy, power consumption or lifetime, and gamma and black level correction of OLED displays that have three or more sub-pixel of different colors and at least one white sub-pixel.

SUMMARY

In accordance with one embodiment, a method and system are provided for controlling an OLED display to achieve desired color points and brightness levels in an array of pixels in which each pixel includes at least three sub-pixels having different colors and at least one white sub-pixel. The method and system select a plurality of reference points in the pixel content domain with known color points and brightness levels. For each set of three sub-pixels of different colors, the method and system determine the share of each sub-pixel to produce the color point and brightness level of each selected reference point, and select the maximum share determined for each sub-pixel as the peak brightness needed from that sub-pixel.

In accordance with another embodiment, the method and system identify tri-color sets of three sub-pixels of different colors that encircle a desired color point, and, for each identified tri-color set of sub-pixels, determine the brightness shares of the sub-pixels in that tricolor set to produce the desired color point. The method and system select a set of share factors based on at least a pixel operation point and display performance, modify the brightness shares based on the share factors, and map the modified brightness shares to pixel input data. In one implementation, The method and system determine the efficiencies of the identified tri-color sets, increase the share factor of the tri-color set with the highest efficiency; decrease the share factor of the tri-color set with the lowest efficiency, as the gray scale of the desired color point increases, and decrease the share factor of the tri-color set with the highest efficiency, and increase the share factor of the tri-color set with the lowest efficiency, as the gray scale of the desired color point decreases.

A further embodiment provides an OLED display comprising san array of pixels in which each pixel includes at least three sub-pixels having different colors and at least one white sub-pixel for displaying desired color points and brightness levels. Each pixel includes at least three sub-pixels having different colors and at least one white sub-pixel, the sub-pixels having operating conditions that vary with the gray level displayed by the sub-pixel. The pixel has at least two sub-pixels for displaying the same color but having operating conditions that vary differently with the gray level being displayed. A controller selects one of the two sub-pixels displaying the same color, in response to a gray level input to that pixel.

BRIEF DESCRIPTION OF THE DRAWINGS

The foregoing and other advantages of the invention will become apparent upon reading the following detailed description and upon reference to the drawings.

Figure 1:
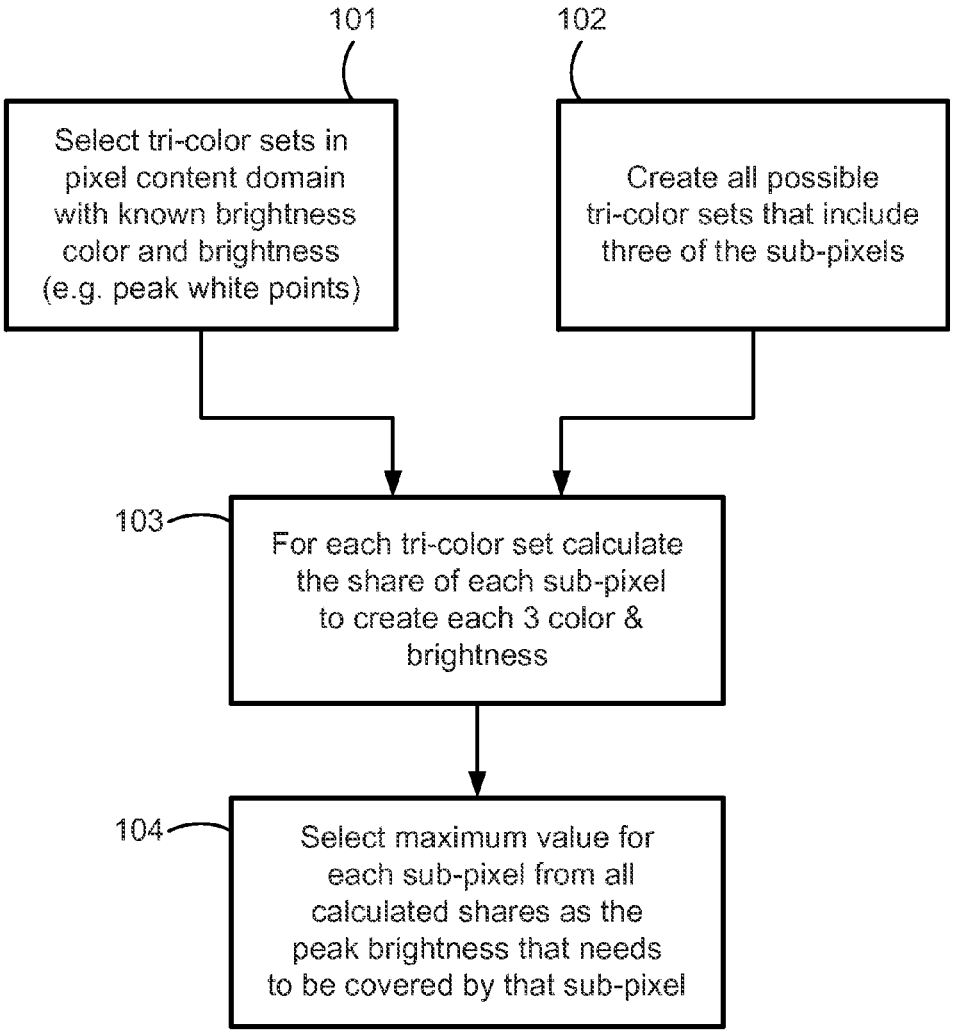
FIG. 1 is a flow chart of a routine for calculating the peak brightness of each sub-pixel in a display.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Sub-Pixel Mapping

To improve color accuracy, power consumption or lifetime, OLED displays may have more than three primary sub-pixel colors. Therefore, proper color mapping is needed to provide continuous color space despite transitions between different color elements. Each pixel in such OLED displays consists of n sub-pixels $\{SP_1, SP_2, SP_3 \ldots SP_n\}$. The peak brightness that each sub-pixel should be able to create can be calculated, and used for the design of the display or for adjusting the gamma levels to required levels.

FIG. 1 is a flow chart of an exemplary routine for calculating the peak brightness for each sub-pixel. The first step 101 selects a plurality of reference points, with known color and brightness, such as peak white points, in the pixel content domain. Step 102 identifies all possible tri-color sets that include three of the sub-pixels. Then for each tri-color set, step 103 calculates the share of each sub-pixel to create the reference content point, i.e., the color and brightness. Step 104 selects the maximum value for each sub-pixel, from all the calculated shares, as the peak brightness that needs to be provided that sub-pixel.

The following is an example of calculating the brightness shares for a tri-color set of sub-pixels for a given white point and peak brightness:

```
function [Green Red Blue] = Color_Sharing_RGB (Rc, Gc, Bc, Wc)
%% Rc, Gc, Bc the color points of the tri-color sets
%% Wc is the white color point
    L = 100; %% Peak Brightness
    %% calculating the brightness share
    WM= [Wc(1)-1        0        Wc(1);
        0               1        0;
        Wc(2)           0        Wc(2) ];
    LM= [-Wc(1)*L;
        L;
        -[Wc(2)-1)*L];
    x = inx (WM);
    Wt = x* LM;
    Mt = [Gc(1)/(Gc(2))                Rc(1)/(Rc(2))              Bc(1)/(Bc(2));
        1                              1                          1              ;
        (1-Gc(1)-Gc(2))/Gc(2)          (1-Rc(1)-Rc(2))/Rc(2)      (1-Bc(1)-
    Bc(2))/Bc(2)];
    x2 = inx (Mt) ;
    CR = x2 * Wt; %% CR is the brightsess share of the trio-color set.
    Green = CR(1);
    Red = CR(2);
    Blue = CR(3);
end
```

Figure 2:
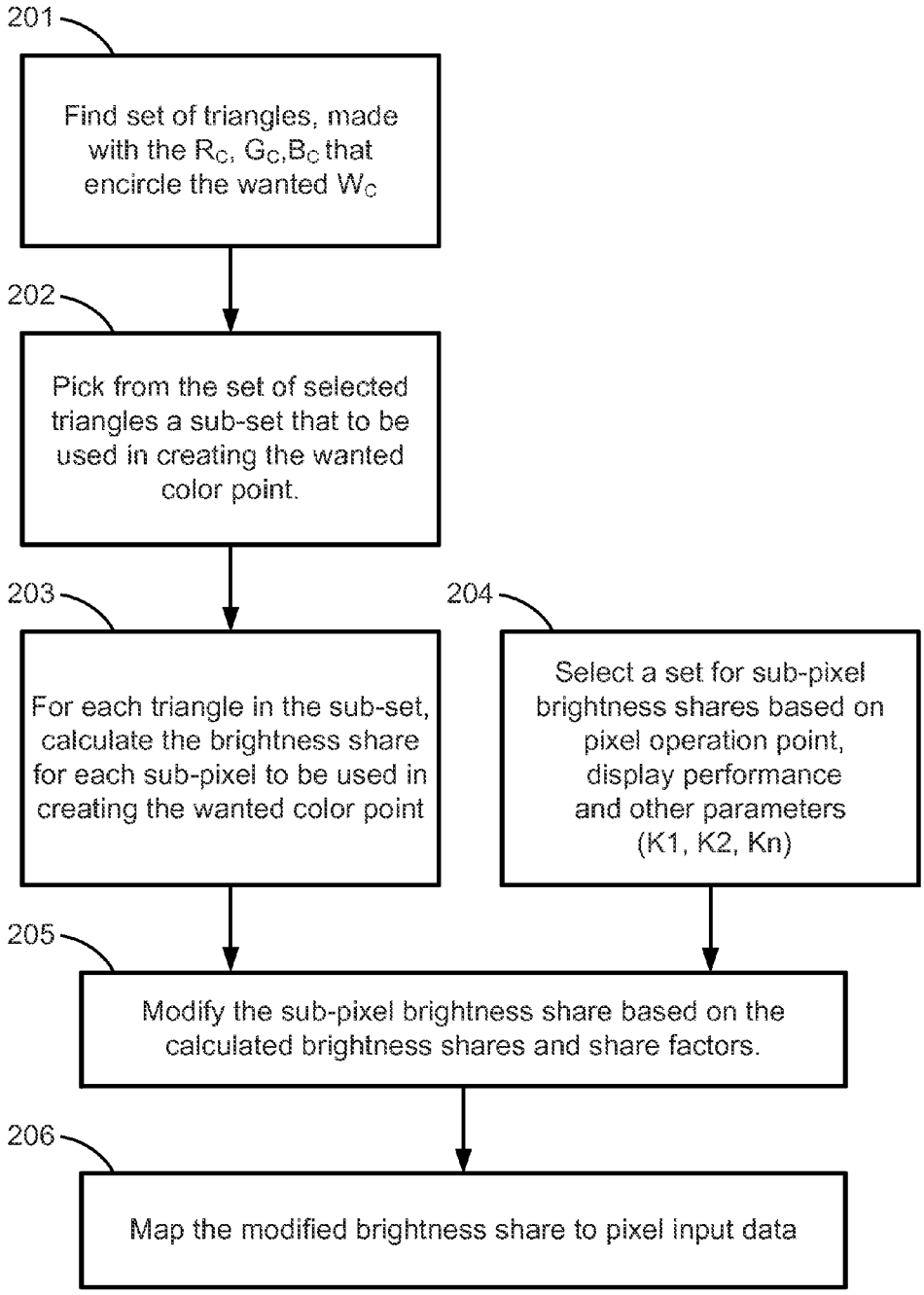
FIG. 2 is a flow chart of a routine for calculating the brightness shares for a tri-color set of sub-pixels.

FIG. 2 is a flow chart of an exemplary routine for calculating the brightness shares for the sub-pixels in a tri-color set. The first step 201 finds a set of triangles, made with the tri-color sub-pixels Rc, Gc, Bc that encircle a wanted white point Wc. Step 202 then selects a sub-set of those triangles to be used in creating the wanted color point Wc. Then for each triangle in the subset of triangles, step 203 calculates the brightness share for each sub-pixel in each triangle to create the wanted color point Wc. Step 204 selects a set of sub-pixel brightness shares based on a pixel operation point, display performance and other parameters (K1, K2 . . . Kn). Step 205 then uses the outputs of steps 203 and 204 to modify the sub-pixel brightness shares, based on the calculated brightness shares and share factors. Finally, step 206 maps the modified brightness shares to the pixel input data.

Different standards exist for characterizing colors. One example is the 1931 CIE standard, which characterizes colors by a luminance (brightness) parameter and two color coordinates x and y. The coordinates x and y specify a point on a CIE chromatacity diagram, which represents the mapping of human color perception in terms of the two CIE parameters x and y. The colors that can be matched by combining a given set of three primary colors, such as red, green and blue, are represented by a triangle that joins the coordinates for the three colors, within the CIE chromaticity diagram.

The following is an example of the brightness shares:
The parameters x and y for the color points of the tri-color set and intended white point are as follows:
Rc=[0.66 0.34]
Bc=[0.14 0.15]
Gc=[0.38 0.59]
Wc=[0.31 0.33]
[Green Red Blue]=Color_Sharing_RGB (Rc, Gc, Bc, Wc)
The color shares for the tri-color set are as follows:
Green=59.8237%
Red=17.7716%
Blue=22.4047%

Figure 3:
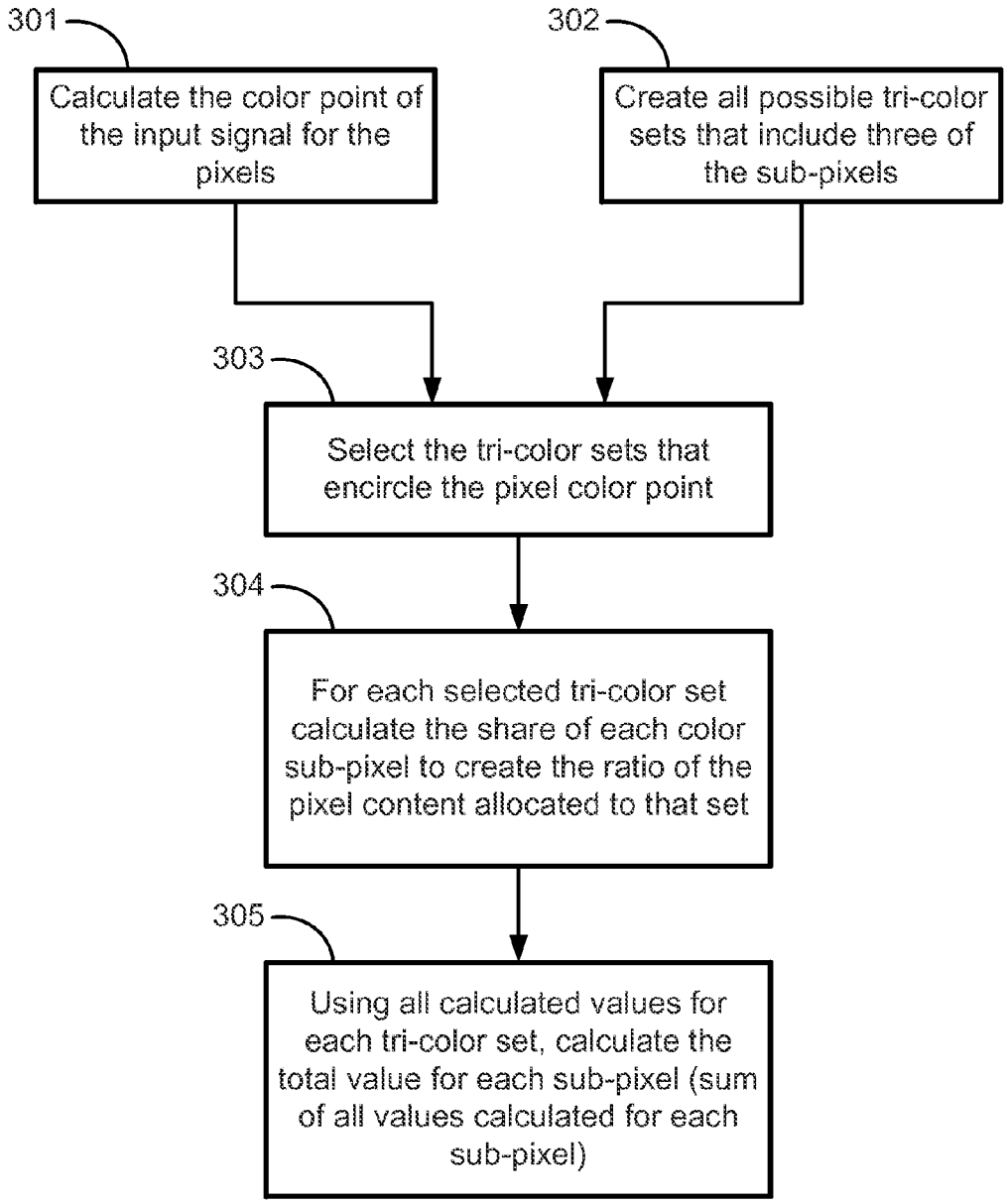
FIG. 3 is a flow chart of a routine for content mapping based on multiple sub-pixel colors in a display.

Each of the tri-color sets that encircles the pixel content will create a share of the pixel contents $K_1, K_2 \ldots K_m$, where the $K_i$'s are the shares of the respective sub-pixels in each tri-color set in the pixel content. The value of each sub-pixel in each of the tri-color sets is calculated considering the share of each tri-color. One such method is based on the function illustrated in FIG. 3, where step 301 calculates the color point of the input signal for the pixels, and step 302 creates all possible tri-color sets that include three of the sub-pixels. Step 303 then selects the tri-color sets that encircle the pixel color point, and step 304 calculates the share of each color sub-pixel to create the ratio of the pixel content allocated to each selected tri-color set. Step 305 uses all the calculated values for each tri-color set to calculate the total value for each sub-pixel, e.g., the sum of all values calculated for each sub-pixel.

Figure 4:
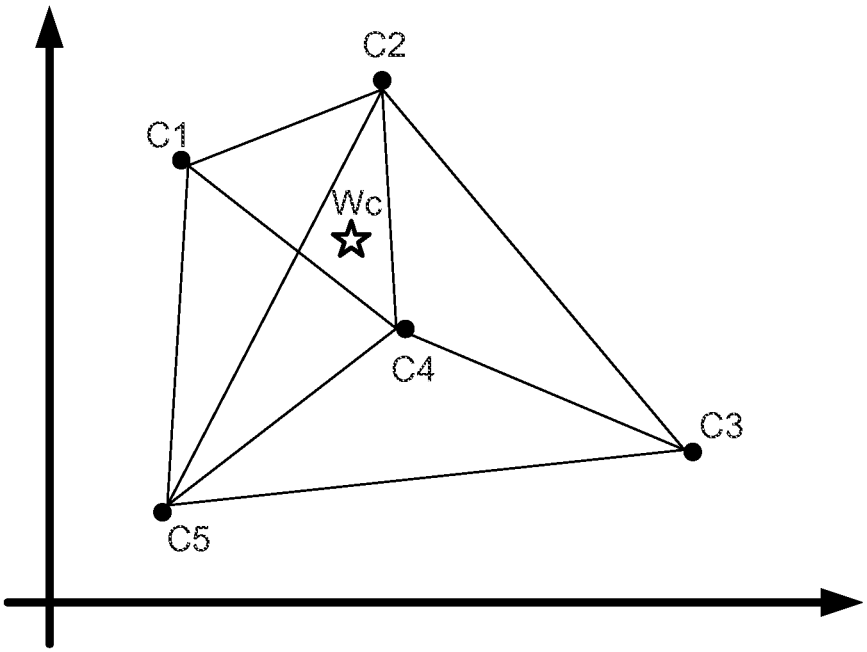
FIG. 4 is a diagram of a multiple sub-pixel display structure.

FIG. 4 shows an example of a display incorporating more than three sub-pixel colors (C1, C2, C3, C4, C5) and a wanted color point of Wc. As can be seen, the color point Wc can be created by any of {C1, C2, C4}, {C2, C4, C5}, {C2, C3, C5}, and {C1, C2, C3}. To create the wanted color Wc, one can use the algorithm described above. Also, one can use share factors to create the wanted color based on the sum of all the sets, such as:
Wc=K1*{C1, C2, C4}+K2*{C2, C4, C5}+K3*{C2, C3, C5}+K4*{C1, C2, C3},
where the Ki's are the share factors for the tri-color set.
Dynamic Share Factor Adjustment The share of each tri-color set can be varied based on the pixel content. For example, some sets provide better characteristics (e.g., uniformity) at some grayscales, whereas other sets can be better for other characteristics (e.g., power consumption) at different grayscales.

Figure 5:
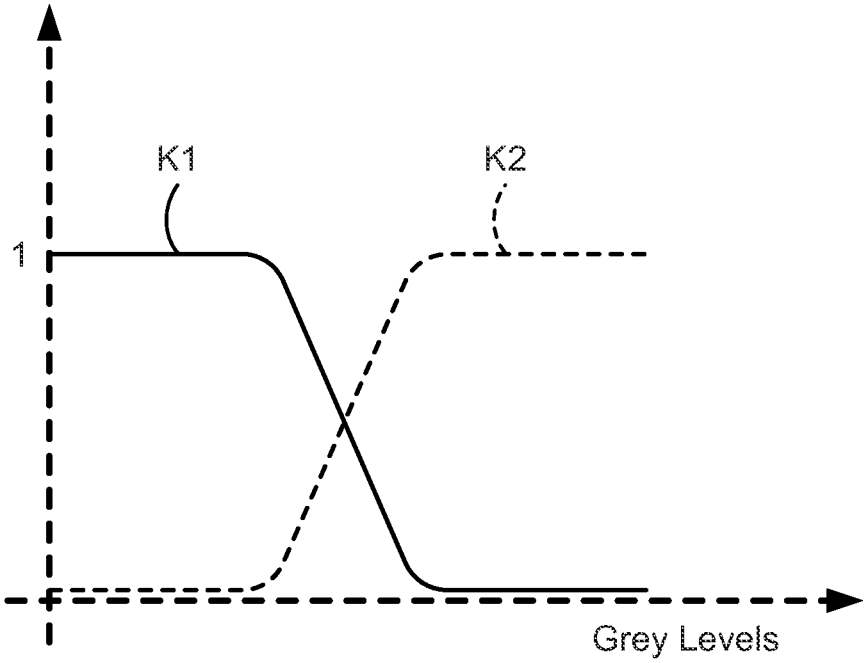
FIG. 5 is a graph of an example of share factors as a function of gray levels of a tricolor set with the lowest and highest efficiencies K1 and K2.

In one example, a display consists of Red, Green, Blue and White sub-pixels. The white sub-pixel is very efficient and so it can provide lower power consumption at high brightness. However, due to higher efficiency, the non-uniformity compensation does not work well at lower gray scales. In this case, low gray scales can be created with less efficient sub-pixels (e.g., red, green, and blue). Thus, the share factor can be a function of gray scales to take advantage of different set strengths at each gray level. For example, the share factor of a tri-color set with the lowest efficiency (K1) can be reduced at higher gray levels and increased at lower gray scales. And the share factor of the tri-color set with the highest efficiency (K2=1−K1) can be increased as the gray scale increases. Thus, the display can have both lower-power consumption at higher brightness levels and higher-uniformity at lower gray scales. This function can be step, a linear function or any other complex function. However, a smoothing function can be used at large transitions to avoid contours. FIG. 5 shows an example of the share factors for a two tri-color set system.

Locally Optimized Sub-Pixels

Due to the wide range of specifications for display performance, the sub-pixels will have an optimum operation point, and diverging from that point can affect one or two specifications. For example, to achieve low power consumption, one can use drive TFTs that are as large as possible to reduce the operating voltage. On the other hand, at low current levels, the TFTs will operate in a non-optimized regime of operation (e.g., sub-threshold). On the other hand, using small TFTs to improve the low grayscale performance will affect the power consumption and lifetime due to using large operating currents.

Figure 6:
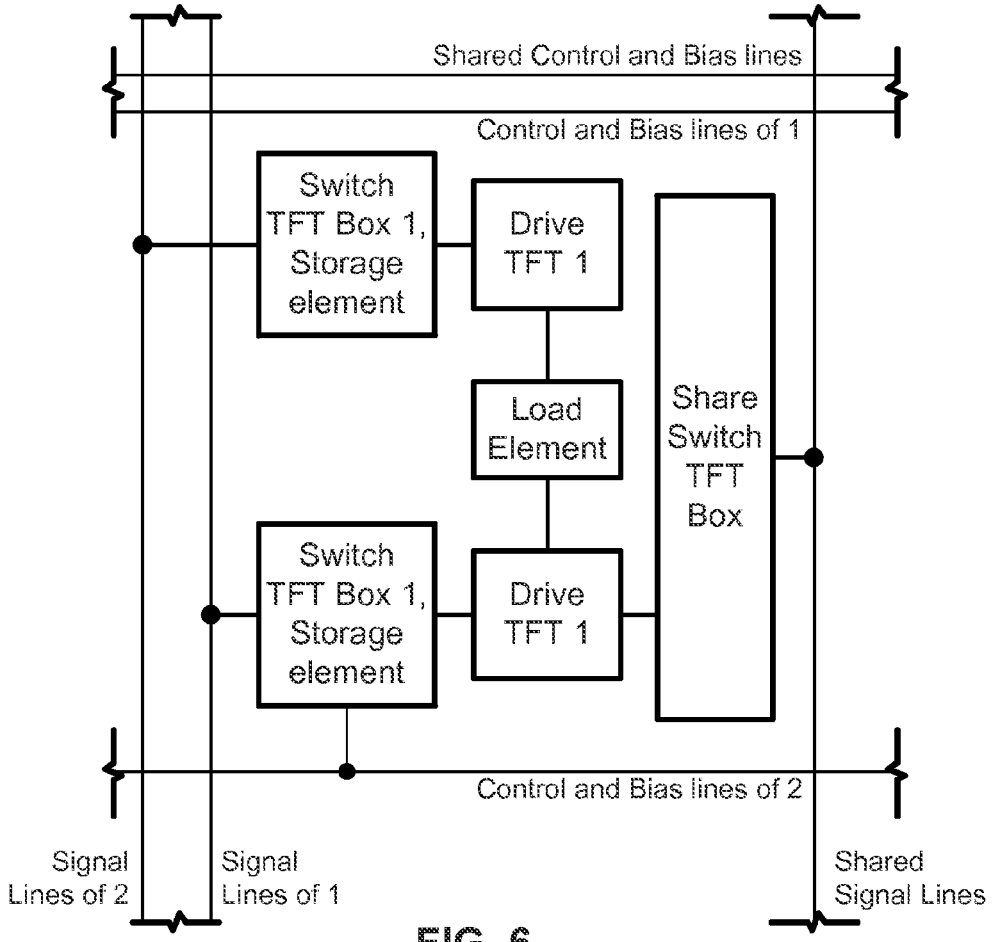
FIG. 6 is a block diagram of two locally optimized sub-pixels.

To address the difficulty in having a single sub-pixel optimized across all gray levels and operation ranges (e.g. different environmental conditions, brightness levels, etc), one can add sub-pixels optimized for different operating ranges. To optimize the operation of each sub-pixel for a specific gray-level set, one can change the component size or use a different pixel circuit for each locally optimized sub-pixel. Here, one can share all or some components of the sub-pixel (e.g., OLEDs, bias transistors, bias lines, and others). FIG. 6 illustrates an example using two locally optimized sub-pixels with some shared components and some dedicated components to each sub-pixel. Also, one can have two different load elements (e.g., OLEDs). In this example, the current required for either shared load or combined separate load elements is generated by both sub-pixels 1 and 2 where I1=A1*I and I2=A2*I (I is the total current required for the load, I1 is the current generated by sub-pixel #1, 12 is the current generated by sub-pixel #2, and A2=(1−A1)). Here, A1 and A2 are adjusted for different gray-scales (or operating conditions) to adjust the ratio of each sub-pixel in generating the current.

One can add sub-pixels optimized for different operating ranges. Here, one can share all or some components of the pixel (e.g., OLED, bias transistors, bias lines, and others).

Figure 7:
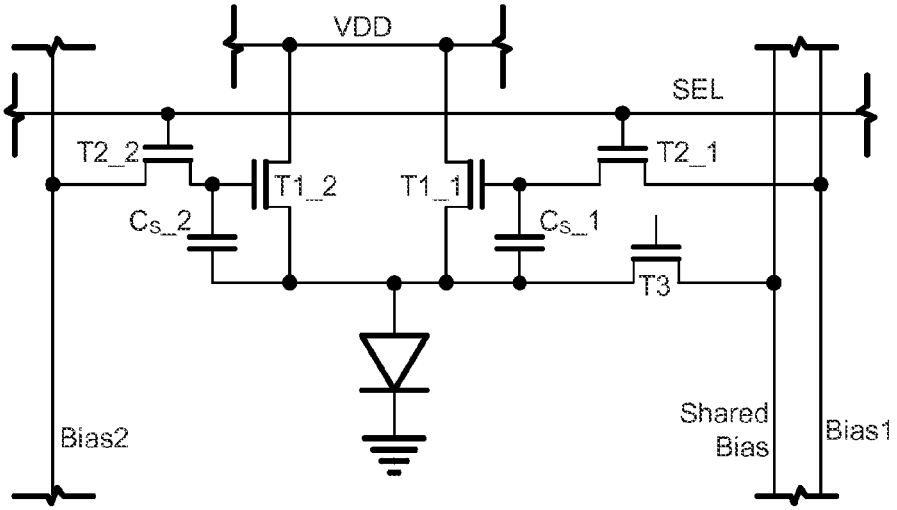
FIG. 7 is an electrical schematic diagram of a pixel circuit having two locally optimized sub-pixels.

FIG. 7 is a circuit diagram of an exemplary embodiment in which the drive TFT (T1), the programming switch TFT (T2), and the storage element ($C_S$) are optimized for each sub-pixel. Also, the TFT T3, the bias line, the select line (SEL) and the power line (VDD) are shared. In one case, different sizes of drive TFTs can be used to optimize the sub-pixels for different ranges of operation. For example, one can use a smaller drive TFT for one sub-pixel to be used for lower gray scales, and a larger drive TFT for the other sub-pixel to be used for higher gray scales.

Selecting each sub-pixel can be done either through a switch that activates or deactivates the sub-pixel, or through programming a sub-pixel with an off voltage to deactivate it.

The locally optimized sub-pixel method can be used for all sub-pixels or for only selected sub-pixels. For example, in the case of a RGBW sub-pixel structure, optimizing white sub-pixels across all gray levels is very difficult due to high OLED efficiency, while other sub-pixels can be optimized more easily. Thus, one can use a locally optimized sub-pixel method only for the white sub-pixel.

Gamma and Black Level Correction

Figure 8B:
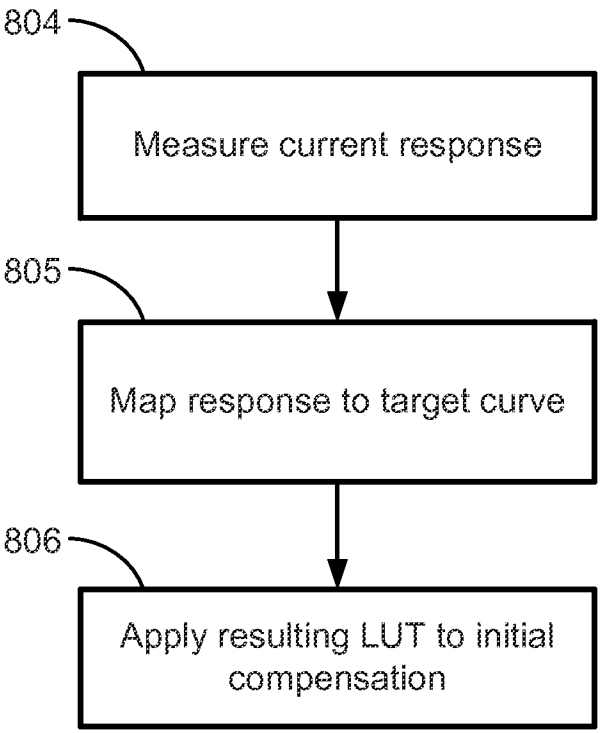
FIG. 8B is a flow chart of a procedure for using a measured current response to determine a lookup table for initial compensation of a display panel.
Figure 8A:
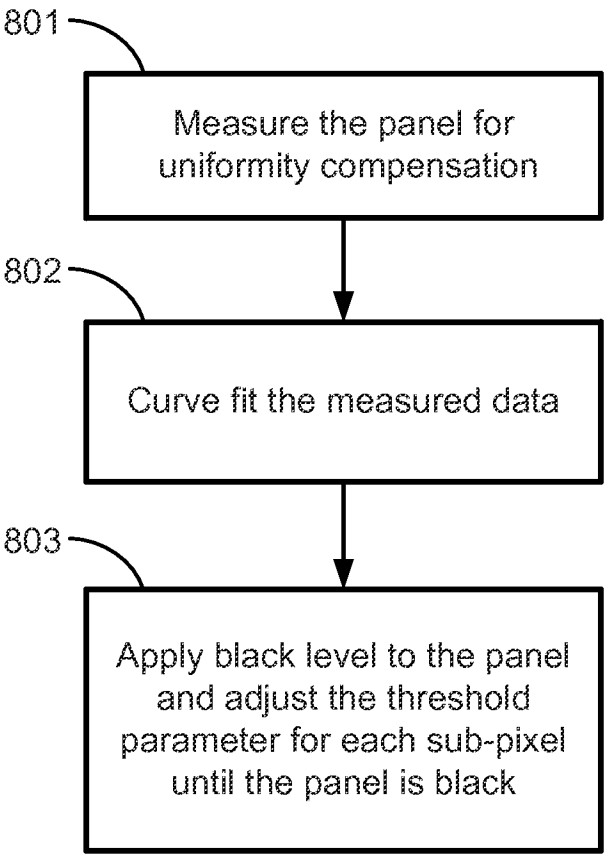
FIG. 8A is a flow chart of a procedure for adjusting the black level of a display panel based on panel uniformity measurements.

A gamma calibration procedure ensures that colors displayed by a panel are accurate to the desired gamma curve, usually 2.2. The procedure has now been largely automated. The target white-point and curve are parameterized. The high level process is shown in FIGS. 8A and 8B. This procedure assumes that initial uniformity compensation for the panel has already been applied.

In the procedure of FIG. 8A, step 801 measures the display panel for uniformity compensation, and then curve fits the measured data. A black level is applied to the panel, and the threshold parameter for each sub-pixel is adjusted until the panel is black. In the procedure of FIG. 8B, the current response is measured at step 804, and then mapped to a target curve in step 805. Step 806 applies the resulting lookup table to initial compensation.

One advantage of emissive displays is deep black level. However, due to the non-linear behavior of the pixels and non-uniformity in the pixels, it is difficult to achieve black levels based on a continuous gamma curve. In one method, the worst case is chosen, and the off voltage is calculated based on that. Then that voltage, with some margin, is assigned to the black gray level, which generally puts the panel in a deep negative biasing condition. Since some backplanes are sensitive to negative bias conditions, the panel will develop image burn-in and non-uniformity over time.

To avoid that, the black level can be adjusted based on panel uniformity information. In this case, the uniformity of the pixel is measured at step 801 in FIG. 8A, and the threshold voltage (at which the pixel current is assumed to be off) is calculated at step 802. However, since simplified models are used to reduce the calculation and compensation complexity, the calculated threshold voltage will have some error. To assign a black voltage, the threshold voltage of the pixel is reduced at step 803 until the panel turns black. This can be done for each color individually, and the new modified threshold voltage is used for black voltage level.

In another aspect of this invention, a plurality of sensors are added to the panel, and the voltage of the black level is adjusted until all sensors provide zero readings. In this case, the initial start of the black level can be the calculated threshold voltage.

In another aspect of this invention, the black level for each sensor is adjusted individually, and a map of black level voltage is created based on each sensor data. This map can be created based on different methods of interpolation.

In another aspect of the invention, the black level has at least two values. One value is used for dark environments and another value is used for bright environments. Since the lower black level is not useful in bright environments, the pixel can be slightly on (at a level that is less than or similar to the reflection of the panel). Therefore, the pixel can avoid negative stress which is accelerated under higher brightness levels.

In another aspect of the invention, the black level has at least two values. One value is used when all the sup-pixels are off, and another value is used when at least one sub-pixel is ON. In this case, there can be a threshold for the brightness level of the ON sub-pixels required to switch to the second black level value for the OFF sub-pixels. For example, if the blue sub-pixel is ON and its brightness is higher than 1 nit, the other sub-pixels can be slightly ON (for example, less than 0.01 nit). In this case, the OFF sub-pixels can eliminate the negative bias stress under illumination.

In another aspect of the invention, the brightness of neighboring sub-pixel can be used to switch between different black level values. In this case, a weight can be assigned to the sub-pixels based on their distance from the OFF sub-pixels. In one example, this weight can be a fixed value, dropping to zero after a distance of a selected number of pixels. In another example, the weight can be a linear drop from one to zero. Also, different complex functions can be used for the weight function.

Measure Current Response

Figure 9:
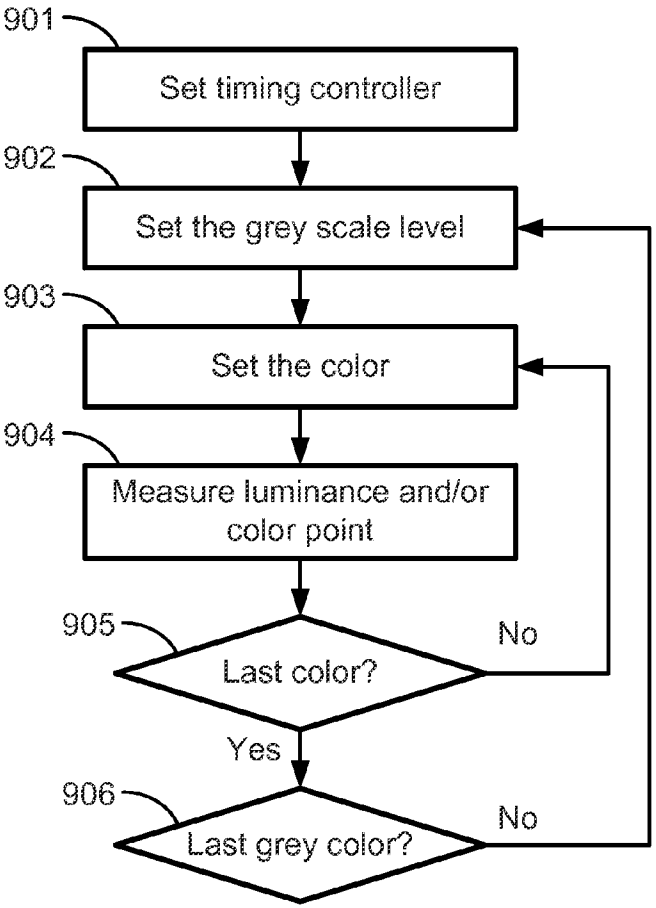
FIG. 9 is a flow chart of a current response measurement procedure.

The steps for a measure-current-response process are summarized in FIG. 9. The initial step 901 sets a timing controller, which ensures that measurements are taken with the display in the correct mode. Specifically, it ensures that the most recent compensation is being displayed on the panel. It also ensures that TFT and OLED corrections required before a gamma function is applied, are enabled while gamma correction and luminance correction are disabled. To avoid having to write the entire frame buffer to a single value, special flat-field registers can be implemented in the timing controller. When the timing controller is placed in this mode, step 902 writes the desired grey scale to the corresponding colors register, which is sufficient to display the desired color. Since characterizing the panel, especially at higher levels, with the entire panel on can lead to lower brightness and/or current limiting, step 903 sets only part of the panel to show the desired color level.

As pre-set list of grey scales is used to determine the measurement points that will be used. In one implementation, a list of 61 levels is used for characterization. These points are not linearly spaced; they are positioned more densely toward the low end of the curve, becoming sparser as the grey level increases. This is done to generally fit a 2.2 curve, not a linear one, and can be adjusted for other gamma curves. The list is ordered from the lowest target level (e.g., 0) to the highest target (e.g., 1023). Also, it can be in any other order. After applying each color level, the resulting luminance and/or color point (CIE-XY) are then recorded at step 904. Multiple measurements are taken, and error checking is employed to ensure the validity of the readings. For example, if the variation in the reading is too great, the setup is not working properly. Or if the reading shows an increasing or decreasing trend, it means the values have not settled yet. If luminance only is measured by a calibrated sensor, these readings are converted to luminance and color point data during processing based on a calibration curve of the sensor. The order of steps can be changed and still obtain valid results. Steps 903 and 904 are repeated until the last color is detected at step 905, after which steps 902-905 are repeated until the last gray color is detected at step 906.

Map Response to Target Curve

Figure 10:
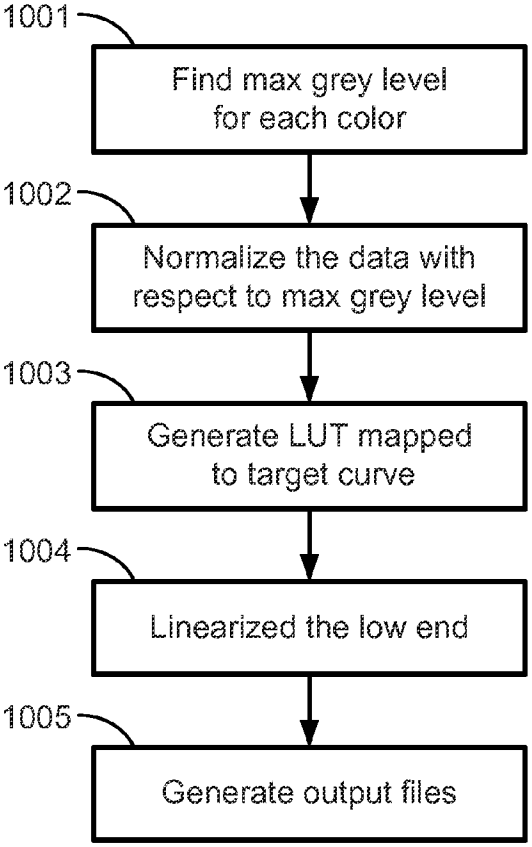
FIG. 10 is a flow chart of a map response to target curve procedure.

The target curve (e.g., the required gamma response) and white-point are specified as input parameters to the mapping function. The steps of this process are summarized in FIG. 10.

The first step is to load the measured data from the generated by the characterization procedure. If the data to be processed is from a calibrated sensor, one additional step is required. The calibration files for the sensor are used to convert the raw sensor readings to luminance and color point values.

Once the data is loaded, the target color point and peak luminance are used to calculate the peak target luminance for each color. Step 1001 finds the grey scale which results in this luminance, which allows the new maximum grey scale for each color to be determined. If any of the colors are not able to achieve the target, the target is adjusted such that the highest achievable brightness is targeted instead. Then the luminance readings are normalized to one, with respect to this new maximum grey scale, at step 1002.

This normalized data can now be used to map the measurements to the target curve, generating a look up table at step 1003. Linear interpolation is used to estimate the luminance between the measurement points. However, different known curve fitting processes can be used as well. The target curve is created by normalizing the target curve and finding the values for each of the points from lowest gray level (e.g., 0) to the highest gray level (e.g., 1023).

Some cases, like the standard sRGB curve, are actually piece wise. In these cases, a different component is used for each part of the curve. For example, for the standard sRGB, there is a linear component at the low end while the remainder of the curve is exponential. As a result, linearization is applied to the low end of the lookup table at step 1004. The point where linearization needs to be applied can be extracted from mapping the measured data to the standard. For example, the linearization can be applied to the first 100 grey scales where gray 100 represents the brightness points that the standard identifies and the change in the curve.

After the linearization is applied, all that remains is to write the resulting lookup table (LUT) to the appropriate output formats, at step 1005.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A method of controlling an OLED display to achieve desired color points and brightness levels in an array of pixels in which each pixel includes at least three sub-pixels having different colors and at least one white sub-pixel, said method comprising selecting a plurality of reference points in a pixel content domain with known color points and brightness levels, identifying all possible tri-color sets of three sub-pixels from the at least three sub-pixels having different colors and the at least one white sub-pixel;

for each tri-color set of three sub-pixels, determining a share of each sub-pixel to produce the color point and brightness level of each selected reference point, and selecting the maximum share determined for each sub-pixel as the peak brightness needed for that sub-pixel.

2. The method of claim 1 wherein the at least three sub-pixels having different colors of each pixel comprises red, green and blue sub-pixels.

3. A system for controlling an OLED display to achieve desired color points and brightness levels in an array of pixels in which each pixel includes at least three sub-pixels having different colors and at least one white sub-pixel, said system comprising a processor configured to select a plurality of reference points in a pixel content domain with known color points and brightness levels, identify all possible tri-color sets of three sub-pixels from the at least three sub-pixels having different colors and the at least one white sub-pixel, determine, for each tri-color set of three sub-pixels, a share of each sub-pixel to produce the color point and brightness level of each selected reference point, and select the maximum share determined for each sub-pixel as the peak brightness needed for that sub-pixel.

4. The system of claim 3 wherein the at least three sub-pixels having different colors of each pixel comprises red, green and blue sub-pixels.

5. A method of controlling an OLED display to achieve desired color points and brightness levels in an array of pixels in which each pixel includes at least three sub-pixels having different colors and at least one white sub-pixel, said method comprising identifying two or more tri-color sets of three sub-pixels of different colors that encircle a desired color point, for each identified tri-color set of sub-pixels, determining the brightness shares of the sub-pixels in that tricolor set to produce the desired color point, for each identified tri-color set of sub-pixels, selecting a set of share factors based on at least one of a pixel operation point and display performance, modifying said brightness shares based on said share factors, and mapping the modified brightness shares to pixel input data.

6. The method of claim 5 which includes determining the efficiencies of the identified tri-color sets, increasing the set share factor of one of the tri-color sets with the highest efficiency, decreasing the set share factor of one of the tri-color sets with the lowest efficiency, as the gray scale of the desired color point increases, and decreasing the share factor of the tri-color set with the highest efficiency, and increasing the share factor of the tri-color set with the lowest efficiency, as the gray scale of the desired color point decreases.

7. The method of claim 5 in which each tricolor set of sub-pixels of different colors is a set of red, green and blue sub-pixels.

8. A system for controlling an OLED display to achieve desired color points and brightness levels in an array of pixels in which each pixel includes at least three sub-pixels having different colors and at least one white sub-pixel, said system comprising a processor configured to identify two or more tri-color sets of three sub-pixels of different colors that encircle a desired color point, determine, for each identified tri-color set of sub-pixels, the brightness shares of the sub-pixels in that tricolor set to produce the desired color point, select, for each identified tri-color set of sub-pixels, a set share factor based on at least one of: a pixel operation point and display performance, modify said brightness shares based on said set share factors, and map the modified brightness shares to pixel input data.

9. The system of claim 8 which said processor is configured to:

determine the efficiencies of the identified tri-color sets, increase the set share factor of one of the tri-color sets with the highest efficiency, and decrease the set share factor of one of the tri-color sets with the lowest efficiency, as the gray scale of the desired color point increases, and decrease the set share factor of the tri-color set with the highest efficiency, and increase the set share factor of the tri-color set with the lowest efficiency, as the gray scale of the desired color point decreases.

10. The system of claim 8 in which each tri-color set of sub-pixels of different colors is a set of red, green and blue sub-pixels.

11. A method of controlling an OLED display to achieve desired color points and brightness levels in an array of pixels in which each pixel includes at least three sub-pixels having different colors and at least one white sub-pixel, said method comprising determining the color point of an input signal for a selected pixel, identifying all tri-color sets of three sub-pixels of different colors, selecting two or more tri-color sets that encircle said color point of said input signal, for each selected tri-color set of sub-pixels, determining brightness shares of the three sub-pixels of that tri-color set to produce said color point of said input signal, selecting, for each identified tri-color set of sub-pixels, a set share factor based on at least one of: a pixel operation point and display performance, modifying said brightness shares based on said set share factors, and mapping the modified brightness shares to pixel input data.

12. The method of claim 11 in which each tri-color set of sub-pixels of different colors is a set of red, green and blue sub-pixels.

13. An OLED display comprising an array of pixels in which each pixel includes at least three sub-pixels having different colors and at least one white sub-pixel for displaying desired color points and brightness levels, said sub-pixels having operating conditions that vary with the gray level displayed by the sub-pixel, said pixel having at least two sub-pixels for displaying the same color but having operating conditions that vary differently with the gray level being displayed, and a controller for selecting one of the two sub-pixels displaying the same color, in response to a gray level input to that pixel.

14. The OLED display of claim 13 wherein the at least three sub-pixels having different colors of each pixel comprises red, green and blue sub-pixels.

* * * * *